United States Patent [19]

Chesher

[11] Patent Number: 4,772,012

[45] Date of Patent: Sep. 20, 1988

[54] POSTOPERATIVE DYNAMIC HAND SPLINT

[75] Inventor: Stephen P. Chesher, Louisville, Ky.

[73] Assignee: The Christine M. Kleinert Institute for Hand and Micro-Surgery, Inc., Louisville, Ky.

[21] Appl. No.: 915,063

[22] Filed: Oct. 3, 1986

[51] Int. Cl.[4] ..... A63B 23/00

[52] U.S. Cl. ..... 272/67; 128/26; 128/77; 128/87 R

[58] Field of Search ..... 128/75, 77, 84 R, 85 R, 128/87 R, 87 A, 89 R, 90, 25 R, 26; 474/135; 272/67, 68; 185/45, 37, 39; 254/276; 267/154, 155, 58; 242/107

[56] References Cited

U.S. PATENT DOCUMENTS

| | | | |
|---|---|---|---|
| 124,131 | 2/1872 | Hagerty | 474/135 |
| 623,592 | 4/1899 | Bonney | 272/67 |
| 1,471,948 | 10/1923 | Cox et al. | 128/87 A |
| 3,756,222 | 9/1973 | Ketchum | 128/26 |
| 4,220,334 | 9/1980 | Kanamoto et al. | 272/67 |
| 4,644,938 | 2/1987 | Yates et al. | 128/77 X |

FOREIGN PATENT DOCUMENTS

| | | | |
|---|---|---|---|
| 0296618 | 2/1917 | Fed. Rep. of Germany | 128/26 |
| 0841537 | 7/1960 | United Kingdom | 272/67 |
| 2165764 | 4/1986 | United Kingdom | 272/67 |

OTHER PUBLICATIONS

Becker, H. and Hardy, M., "A Constant Tension Dynamic Splint." Plastic and Reconstructive Surgery, vol. 66, No. 1, pp. 148–150, 1980.

Slattery, P. G. and McGrouther, D. A., "A Modified Kleinert Controlled Mobilization Splint Following Flexor Tendon Repair." Journal of Hand Surgery, vol. 9-B, No. 2, pp. 217–218, 1984.

Tonkin, M. and Lister, G., "Flexor Tendon Surgery–Today and Looking Ahead." Clinics in Plastic Surgery, vol. 13, No. 4, pp. 221–241, 1986.

"Orthése de la Main." Five pages. Scomac, St. Etienne, France. R.C. 73 B 16, undated.

"A Modified Dynamic Splint for Flexor Tendon Injury." Bissonnette, Werntz, Chesher and Kleinert, San Antonbio, Texas, Sep. 12, 1987.

"Simulation of Flexor Coil Device." Kai-nan An Ph.D., Mayo Clinic Orthopedic Biomechanics Laboratory, Rochester, Minn. 55905, Sep. 1987.

"Postop Flexor Tendon Traction Brace." Biomet, Inc., Airport Industrial Park, P.O. Box 587, Warsaw, In. 46580.

J. C. Rouzaud and Y. Allieu, "A Dynamic Aided Hand Splint, Suggested by Means of a Calibrated Spiral Spring." Ann. Chir. Main, 1987, 6, No. 3, 255–259 (French).

Y. Allieu, G. Asencio, R. Gonus, J. Tessier and J. C. Rouzaud, "Suture des Tendons Extenseurs de la Main Avec Mobilization Assistée A'propos de 120 CAS." Supplement to Rev. Cir. Orthop., 1984 (70).

*Primary Examiner*—Richard T. Stouffer

*Attorney, Agent, or Firm*—William R. Price

[57] ABSTRACT

A postoperative dynamic splint for controlled mobilization of a digit following tendon repair consists of a supportive brace assembly, having an attachment member for attachment of said brace assembly to the distal portion of the arm and the proximal portion of the hand and a tensioning unit which comprises a housing mounted on the supportive brace assembly, a spiral torsion spring mounted at one end to said housing and terminating at its other end to a work arm, which extends out of said housing. The work arm attaches to a rubber band, which is trained under a rotatable roller, mounted on a bracket attached to said brace assembly and at the other end to a connecting member, such as a nail cover, for the affected digit. This allows for extension and flexion of the recuperating digit, so as to prevent adhesion of the tendon to the tendon sheath during the healing process and thus insure full use of the digit after healing.

9 Claims, 2 Drawing Sheets

POSTOPERATIVE DYNAMIC HAND SPLINT

FIELD OF THE INVENTION

This invention relates to a dynamic splint in the management of tendon repairs of injured fingers.

BACKGROUND OF THE INVENTION

Management of tendon injuries presents a continuing dilemma. While it is essential to protect the repaired tendon, immobilization will increase the possibility of adhesion formation. Since the tendons are encased in a synovial sheath, it is the job of the surgeon to repair not only the tendon, but the sheath. If adhesions occur between the tendon and the sheath, or in some cases between adjacent tendons, the postoperative movement of the finger throughout its full range will be lost. As early as 1918, Bunnell ("Repair of Tendons in the Fingers and the Descriptions of Two New Instruments," Surg. Gynecol. Obstet., 126:103–110, 1918) advocated the primary suture of freshly-cut tendons with preservation of the sheath and pulleys, followed by a moderate amount of intermittent movement. This intention, so precisely stated over sixty years ago, remains the objective today. The goal is to provide for the sutured tendon, during its repair and afterwards, a smooth, gliding surface in the synovial sheath and in the pulleys. Controlled movement of the finger following surgery tends to prevent adhesion formation between the tendon and the synovial sheath. Nevertheless, if too much tension is placed on the finger during the postoperative exercise, there is the possibility of tendon rupture. This is to be avoided.

DESCRIPTION OF THE PRIOR ART

The prior art of which applicant is aware is as follows:

1. Becker, H. and Hardy, M., "A Constant Tension Dynamic Splint." Plastic and Reconstructive Surgery, Vol. 66, No. 1, pp. 148–150, 1980.
2. Slattery, P. G. and McGrouther, D. A., "A Modified Kleinert Controlled Mobilization Splint Following Flexor Tendon Repair." Journal of Hand Surgery, Vol. 9-B, No. 2, pp. 217–218, 1984.
3. Tonkin, M. and Lister, G., "Flexor Tendon Surgery-Today and Looking Ahead." Clinics in Plastic Surgery, Vol. 13, 1 No. 4, pp. 221–241, 1986.
4. "Orthese de la Main." Five pages. Scomac, St. Etienne, France. R. C. 73 B 16, undated.

SUMMARY OF THE INVENTION

This invention relates to the provision of a modified Kleinert splint alluded to in the Tonkin, et al article. The splint consists of a supportive brace member, comprising a flexible body portion and a rectangular stiffening metal plate. Mounted on the metal plate at its base is a spiral torsion spring case, containing spiral torsion springs, each spring having one anchoring arm anchored to the end of the case and a work arm extending out of the case. The work arm is mounted for an arc-like movement at essentially 90° from the central axis of the spring. Attached to the work arms of the spring forming the tensioning device is a rubber band, trained under a roller, again mounted on a bracket, containing two arm members supported on spiral torsion springs. The distal end of the rubber band is attached to a connecting member to the distal portion of the finger, such as a nail plate, a strap or the like. The use of this device allows for full digit extension, with a much reduced workload to that of the Kleinert splint. This allows for a full range of extension and flexion of the digit during recuperation, without danger of firing of the muscle controlling the tendon and a concomitant rupture of the sutured tendon.

BRIEF DESCRIPTION OF THE DRAWINGS

Referring now to the drawings.

DESCRIPTION OF THE PREFERRED EMBODIMENT

Figure 1:
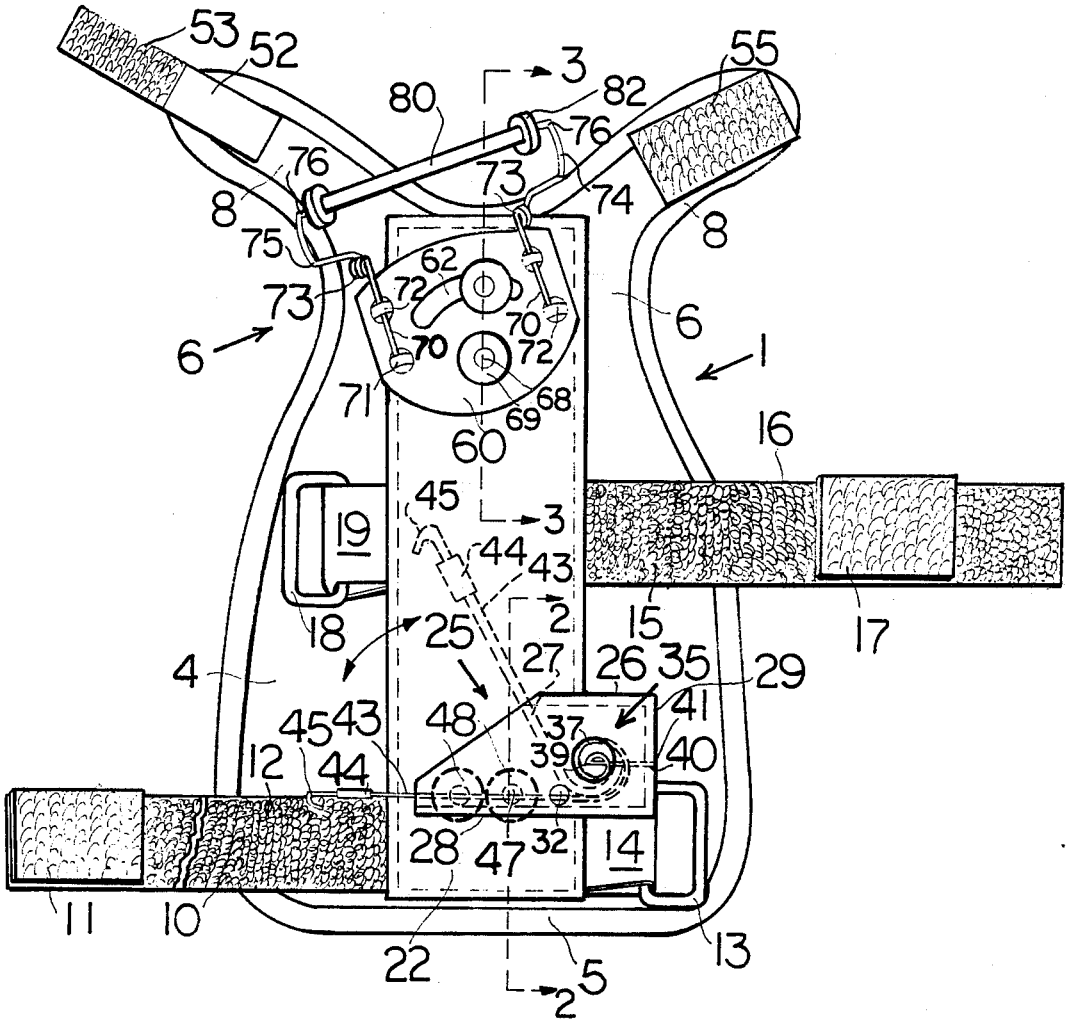
FIG. 1 is a plan view of the dynamic splint of this invention.
Figure 2:
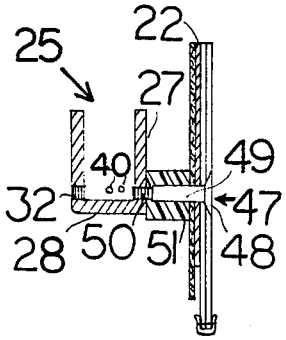
FIG. 2 is a sectional view, taken along lines 2—2 of FIG. 1, illustrating the torsion spring case and its method of attachment to the body of the dynamic splint.
Figure 3:
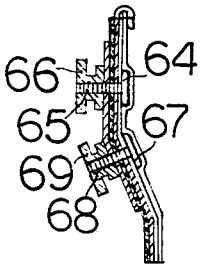
FIG. 3 is a sectional view, taken along lines 3—3 of FIG. 1, illustrating the placement of the roller and the adjustable bracket on which the roller is mounted.

Referring now to the figures and specifically to FIG. 1, the dynamic hand splint of this invention is shown. The hand splint consists of a supportive brace assembly 1 which has a body portion 4, a base portion 5 and a throat portion 6. The ear portions 8 extend laterally above the throat portion 6. This body portion is fabricated of plastic, covered with a fabric and serves as a mounting member for the spiral torsion spring case 25 and for the adjustable bracket holder 60.

Sewn to the body portion 4 of the brace assembly 1 is a strap 10, having a loop (Velcro ®) fastener 11, a hook (Velcro ®) fastener 12 and a loop buckle 13, for the strap 10. The strap 10 is trained over one edge of the buckle 13 and fastened at 14. A second strap 15 about midway up the body 4 of the supportive brace assembly 1 is attached to the body portion 4 and again contains the Velcro ® hook tab 17 for easy fastening. One end of the strap 15 is trained over a side of loop buckle 18 and fastened at 19. The center of the body portion 4 is reinforced with a rectangular metal stiffening plate 22, which extends from the base 5 of the body portion 4, up past the throat portion 6, adjacent the projecting ears 8 of the body portion 4.

Figure 4:
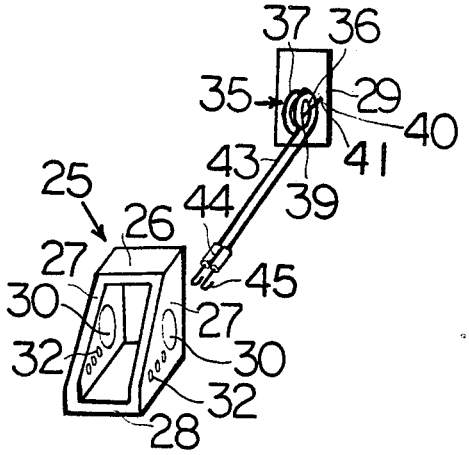
FIG. 4 is an exploded view of the torsion spring case of this device, shown in perspective and illustrating the rear wall of the torsion spring case and its method of attachment to the anchoring arm of the spiral torsion springs, forming the tensioning member of the dynamic splint.

Mounted onto the rectangular metal stiffening plate 22 is the torsion spring case 25, having a top 26, sides 27, a bottom 28 and a rear portion 29. This can best be seen in the exploded view of FIG. 4. In the side wall 27, there are large circular openings 30 and some threaded holes 32. A double spiral torsion spring 35, consisting of coils 36, which are turned to form a terminal coil 37 and angularly bent at 39, to form a projected anchoring arm 40, which anchors into the anchoring hole 41, on the rear portion 29 of the spiral torsion spring case, as is shown in FIGS. 4 and 1. A work arm 43 projects from the outer coil 36 and two work arms are attached together by collar 44 and terminate in attachment hooks 45. The spiral torsion spring case 25 is attached to the body portion 4 and reinforcing plate 22 of the brace member 1, by means of bolt 47, having a bolt head 48 and a shank portion 49, which extends through plastic washer 51 and has threads 50, which engage with the threads of the threaded holes 32 on the side portions 27 of the torsion spring case. The ear portion 8 contains, on one side, a strap 52, having a Velcro ® loop portion 53 and a Velcro ® hook portion on the Velcro ® tab 55 on the other ear portion 8. At about the top of the rectangular metal plate 22 is mounted a bracket holder 60, containing an arcuate slot 62, through which a bolt is trained, having a bolt head 64, a threaded shank 65 and a knurled tightening nut 66, which tightens the bolt at a particular point in the arcuate slot 62. The bracket 60 is mounted to the plate 22 and the body portion 4 of the brace assembly 1 by means of a bolt, having a head 67 and a threaded shank 68, which extends through the body portion 4 and the metal plate 22 and the bracket 60 and is tightened into place by means of a knurled tightening nut 69. A bracket holder for roller 80 is provided with anchoring wires 70, which slip through anchoring loops 71 and 72 of the adjustable bracket 60 and which are enlarged at one end to prevent movement out of the loops. The anchoring wires are bent into spiral torsion springs 73 and the projecting work arm 74 is bent at 75 and at 76 to fit into the internal bore of the roller 80. Roller 80 has guiding collars 82, as shown.

Figure 5:
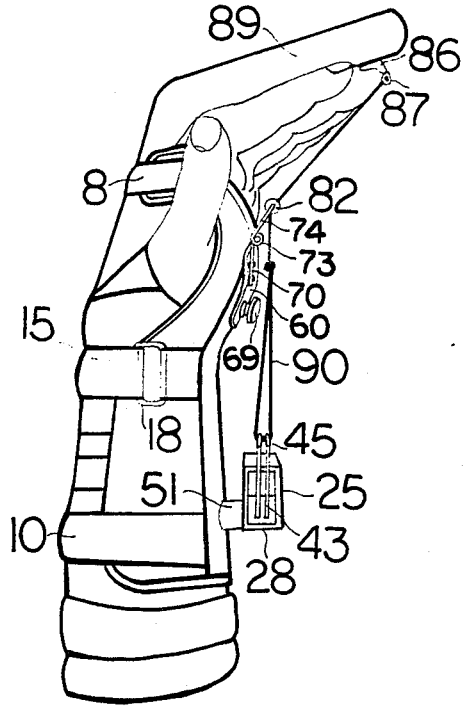
FIG. 5 illustrates the placement of the dynamic splint on the hand of a patient during the early stages of recuperation, in which the hand is pretty well protected by cast material and Ace bandage, with a rigid cast on the dorsal portion of the finger portion of the hand.
Figure 6:
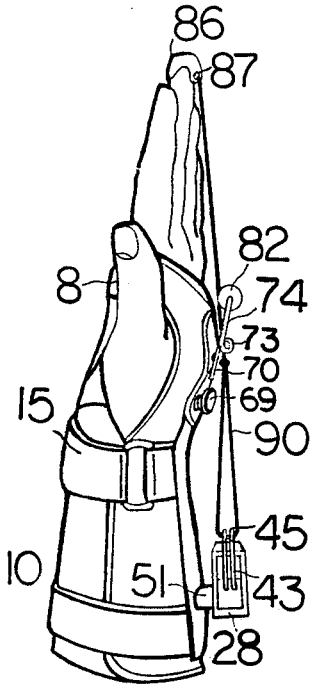
FIG. 6 illustrates the brace attached to the hand of a patient, showing the finger in full extension and flexion, after a period of recuperation in which the dorsal protective cast has been eliminated.

In use, following the operative treatment of a tendon and the tendon sheath, as previously discussed, a connecting member 86, in the form of a nail cover, containing a connecting hook 87, is attached to the affected finger, which in the case illustrated in FIGS. 5 and 6, is the index finger. A rubber band 90 is attached to the hooks 45 of the torsion spring case, trained under roller 80 and connected to hook 87 of the connecting member 86. Since this is directly after surgery, cast material in the form of crinoline saturated with plaster of Paris, gauze and Ace bandage material is wrapped over the distal portion of the ar and the proximal portion of the hand and a rigid cast 89 is provided for the dorsal portion of the fingers. This cast material thus protects the fingers, but allows for extension and flexion of the index finger in the direction of the arrow, as is shown. Since the work arm 43 of the spiral torsion spring allows for movement with a low number of grams and a certain amount of tension is provided by the rubber bands, again through a second set of spiral torsion springs 73 of the holder for the roller, exercise, through flexion and extension of the affected digit, can be begun at an early stage of recuperation at almost constant tension. We have found that with this arrangement, the rubber bands will stretch a full six inches with only 10–15 grams of force. This compares to an extension of almost 160 grams of force over a six-inch extension of the rubber bands. The inertia of the initial stretch is such that 30 grams of force is required to move the rubber band without this device from one-half to one inch. Additionally toward the end of the six-inch stretch, the distance from five to five and one-half inches required 12 grams of force and the force required to stretch the rubber band from five and one-half to six inches was over 15 grams of force. By comparison, only 10–15 grams of force is required with the device of this invention, over the entire six inches of distance. If nylon is substituted for the rubber band in this splint, the grams of force will change from 25–35 grams over the same distance.

Because of the lower tension required for full extension, the distal interphalangeal joint of the finger can be exercised at an early stage following surgery and throughout the recuperation period, thus allowing the full range of motion for each of the joints following surgery and successful management through the use of the dynamic splint of this invention. As is shown in FIG. 6, as the recuperation progresses, the cast and bandage material is removed from the arm and hand, including the dorsal protective cast 89 for the fingers, thus allowing the hand and fingers to be exercised through the full range of movement, as is illustrated.

The work arm 43, as is shown in FIGS. 1, 5 and 6, extends laterally of the spiral torsion spring 35 and terminates in hooks 45. Collar 44 insures the unity of movement of the two arms. The limits of the movement are shown in full and phantom lines in FIG. 1. In FIGS. 5 and 6, the hooks 45 are shown in full lines at the outermost limit of movement, with full extension of the index finger. In FIG. 6, the full flexion of the index finger is shown, together with the hook 45.

As previously mentioned, the spring's tension load can be increased by turning wire 41 (access through opening 30) around its central axis with a needle-nosed plier in a counterclockwise direction. The increased load will be used as recuperation and strengthening of the sutured tendon progresses.

Many modifications will occur to those skilled in the art from the detailed description hereinabove given. This description is meant to be exemplary in nature and nonlimiting except so as to be commensurate in scope with the appended claims.

I claim:

1. A postoperative dynamic splint for the repair of a tendon of an injured digit, comprising:

A. a supportive brace assembly;

B. attachment means for attachment of said brace assembly to the distal portion of the arm and the proximal portion of the hand;

C. a tensioning unit, comprising:

1. a spiral torsion spring housing mounted on the supportive brace assembly;
2. a first spiral torsion spring, mounted at one end to said housing, said torsion spring spiraling around an axis projecting perpendicular from said brace assembly and having
3. a work arm at the other end of said spring extending laterally out of said housing for movement parallel to said brace assembly under tension in an arcuate motion in the direction of force D. a connecting member for the distal portion of said digit;

E. a rotatable roller assembly, including:

1. a bracket mounted to said brace assembly; and
2. a roller mounted on said bracket; and F. a band trained under said roller, which is in operative relation with said work arm and said connecting member.

2. A postoperative dynamic splint, as defined in claim 1, in whioh said supportive brace assembly comprises:

A. a flexible plastic backing material, having a body portion and two ear portions, and B. a rectangular stiffening metal plate on said body portion.

3. A postoperative dynamic splint, as defined in claim 2, in which said ear portions support a strap member and have hook and loop fabric fastening means for said strap member.

4. A postoperative dynamic splint, as defined in claim 1, in combination with an adjustable bracket holder on said brace assembly for holding said bracket in which said holder contains an arcuate slot and bolt means for adjustment on said brace assembly.

5. A postoperative dynamic splint, as defined in claim 4, in which said bracket comprises two wire members, mounted on said bracket holder, said wire members being bent angularly so as to form the mounting for said roller.

6. A postoperative dynamic splint, as defined in claim 5, in which each of said wire members contain a spiral torsion spring.

7. A postoperative dynamic splint, as defined in claim 1, which comprises, in combination:

A. a second spiral torsion spring, mounted in said spiral torsion spring housing and B. a collar connecting the work arm of said second spiral torsion spring to the work arm of said first spring.

8. A postoperative dynamic splint, as defined in claim 1, which includes, in combination, an attaohment hook on said work arm of said spring.

9. A postoperative dynamic splint, as defined in claim 1, in which said attachment means includes a strap mounted to said supportive base assembly, having loop and hook fastening means for attachment around said distal portion of the arm.

* * * * *

UNITED STATES PATENT AND TRADEMARK OFFICE

CERTIFICATE OF CORRECTION

PATENT NO. : 4,772,012

DATED : September 20, 1988

INVENTOR(S) : Stephen P. Chesher

It is certified that error appears in the above-identified patent and that said Letters Patent is hereby corrected as shown below:

Column 3, line 44, "ar" should read --arm--.

Column 4, line 64, "whioh" should read --which--.

Signed and Sealed this

Fourth Day of April, 1989

*Attest:*

*Attesting Officer*

DONALD J. QUIGG

*Commissioner of Patents and Trademarks*